US010731464B2

(12) United States Patent
Bachmaier et al.

(10) Patent No.: US 10,731,464 B2
(45) Date of Patent: Aug. 4, 2020

(54) LINEAR ACTUATOR AND METHOD FOR OPERATING SUCH A LINEAR ACTUATOR

(71) Applicant: SIEMENS AKTIENGESELLSCHAFT, Munich (DE)

(72) Inventors: Georg Bachmaier, Munich (DE); Marco Cyriacks, Munich (DE); Reinhard Freitag, Munich (DE); Andreas Gödecke, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 176 days.

(21) Appl. No.: 15/500,833

(22) PCT Filed: Jul. 20, 2015

(86) PCT No.: PCT/EP2015/066534
§ 371 (c)(1),
(2) Date: Jan. 31, 2017

(87) PCT Pub. No.: WO2016/016031
PCT Pub. Date: Feb. 4, 2016

(65) Prior Publication Data

US 2017/0218758 A1 Aug. 3, 2017

(30) Foreign Application Priority Data

Jul. 31, 2014 (DE) ..... 10 2014 215 110

(51) Int. Cl.
*F01B 3/00* (2006.01)
*F04B 17/04* (2006.01)
(Continued)

(52) U.S. Cl.
CPC ..... *F01B 3/0023* (2013.01); *F01B 3/002* (2013.01); *F04B 17/04* (2013.01); *F04B 39/121* (2013.01);
(Continued)

(58) Field of Classification Search
CPC .... F01B 3/0023; F01B 3/002; F15B 13/0401; F15B 13/044; F15B 11/08;
(Continued)

(56) References Cited

U.S. PATENT DOCUMENTS 3,018,735 A 1/1962 Schindler
3,500,079 A * 3/1970 Barthalon ..... H02K 33/02 310/15
(Continued)

FOREIGN PATENT DOCUMENTS

DE 1088684 B 9/1960
DE 1703413 A1 1/1972
(Continued)

OTHER PUBLICATIONS

Translation of DE102004042208A1, Feb. 2007, Damm; Ansgar, F04B17/04.*
(Continued)

*Primary Examiner* — Patrick Hamo
*Assistant Examiner* — David N Brandt
(74) *Attorney, Agent, or Firm* — Lempia Summerfield Katz LLC

(57) ABSTRACT

The linear actuator comprises a double-chamber solenoid pump comprising at least one pump coil, a multi-way valve and at least one pump armature that can be moved by energizing the at least one pump coil and is provided with a switching armature by means of which the multi-way valve can be switched and which can be moved by energizing the at least one pump coil. In the method, both the switching
(Continued)

armature and the pump armature are moved by energizing the pump coil.

16 Claims, 11 Drawing Sheets

(51) Int. Cl.
*F04B 39/12* (2006.01)
*F15B 13/04* (2006.01)
*F15B 13/044* (2006.01)
*F04B 45/047* (2006.01)

(52) U.S. Cl.
CPC ..... *F15B 13/0401* (2013.01); *F15B 13/044* (2013.01); *F04B 45/047* (2013.01)

(58) Field of Classification Search
CPC .... F15B 2211/7051; F15B 2211/30525; F04B 17/04; F04B 39/121; F04B 43/04; F04B 43/026; F04B 43/043; F04B 43/025; F04B 45/047; F04B 53/10; F04B 43/0045; F04B 45/027
See application file for complete search history.

(56) References Cited

U.S. PATENT DOCUMENTS

| | | | | |
|---|---|---|---|---|
| 3,874,822 | A | 4/1975 | Nakamura | |
| 5,013,223 | A | 5/1991 | Takahashi et al. | |
| 6,264,601 | B1 * | 7/2001 | Jassawalla | A61M 1/1053 600/16 |
| 6,969,345 | B2 * | 11/2005 | Jassawalla | A61M 1/1046 600/16 |
| 2016/0294020 | A1 | 10/2016 | Schwab et al. | |

FOREIGN PATENT DOCUMENTS

| | | | | | |
|---|---|---|---|---|---|
| DE | 2614004 | A1 | | 10/1976 | |
| DE | 3102032 | A1 | | 8/1982 | |
| DE | 102004042208 | A1 | | 1/2007 | |
| DE | 102004042208 | A1 | * | 2/2007 | F04B 17/04 |
| DE | 102007014709 | A1 | | 9/2008 | |
| JP | 56025366 | | * | 3/1981 | H02K 33/12 |
| JP | 56025366 | A | * | 3/1981 | H02K 33/12 |
| JP | S5759981 | U | | 4/1982 | |
| JP | S5846861 | A | | 3/1983 | |
| JP | H06185457 | | * | 7/1994 | F04B 17/04 |
| JP | H06185457 | A | | 7/1994 | |
| JP | H0727041 | A | | 1/1995 | |
| JP | 2017505506 | A | | 2/2017 | |
| WO | WO2014069435 | A1 | | 5/2014 | |

OTHER PUBLICATIONS

JPH06185457 translation, JPH06185457, Jul. 1994, Nozawa Toshiyuki, F04B17/04.*
Directional Control Valves Symbols _ Hydraulic Valve, Feb. 2019.*
JP56025366 translation, Yokoo, Hitoshi (Year: 1981).*
JPH06185457 translation, Nozawa Toshiyuki (Year: 1994).*
Directional Control Valve Symbols_Hydraulic Valve (Year: 2019).*
Chinese Office Action for Chinese Application No. 201580040771.6 dated Nov. 7, 2018.
Japanese Grant Decision for Japanese Application No. 2017-505506, dated Nov. 12, 2018.
Japanese Office Action for Japanese Application No. 2017-505506, dated Feb. 19, 2018.
German Search Report for related German Application No. 10 2014 215 110.4 dated Oct. 29, 2015, with English Translation.
PCT International Search Report and Written Opinion of the International Searching Authority dated Nov. 6, 2015 or corresponding PCT/EP2015/066534, with English Translation.

* cited by examiner

LINEAR ACTUATOR AND METHOD FOR OPERATING SUCH A LINEAR ACTUATOR

This application is the National Stage of International Application No. PCT/EP2015/066534, filed Jul. 20, 2015, which claims the benefit of German Patent Application No. 10 2014 215 110.4, filed Jul. 31, 2014. The entire contents of these documents are hereby incorporated herein by reference.

BACKGROUND

The present embodiments relate to a linear actuator and a method for operating such a linear actuator.

Linear actuators are previously disclosed in numerous designs. Stepping motors are disclosed, for example; however, in many cases, these are accurate only to a limited degree. Also previously disclosed are pneumatic and hydraulic linear drives that are connected via a two-way valve to a compressed air reservoir or via a hydraulic pump. Precise regulation is also difficult in the case of these embodiments. Electrodynamic linear motors that are configured as electrical driving machines are also previously disclosed. The electrodynamic linear motors are of fast and accurate construction; however, the electrodynamic linear motors are complicated and are incapable of sufficiently space-saving design. Linear actuators based on piezo crystals or magnetostrictive materials find an application in specific areas; however, the linear actuators based on piezo crystals or magnetostrictive materials are designed only for very small movement paths. Although piezo motors based on frictional contacts have the ability to execute larger strokes, the piezo motors are frequently restricted in terms of service life and are susceptible to environmental influences. Artificial muscles based on electrostatic action mechanisms are also previously disclosed, although the artificial muscles are limited with respect to maximum power and service life.

SUMMARY AND DESCRIPTION

The scope of the present invention is defined solely by the appended claims and is not affected to any degree by the statements within this summary.

Linear actuators may be constructed with the smallest possible dimensions and, wherever possible, may be operable electrically and for long periods in the absence of wear. Linear actuators may be as robust as possible in the face of adverse environmental conditions (e.g., contamination). Such linear actuators may be readily interconnectable. A number of linear actuators are to be positioned in the case of complicated actuator configurations. Such a linear actuator may exhibit the smallest possible number of electrical conductors or conductor terminations for electrical connection, therefore, in order to minimize the overall number of required lines.

The present embodiments may obviate one or more of the drawbacks or limitations in the related art. For example, a linear actuator that is space-saving and/or capable of the simplest possible electrical connection is provided. As another example, a method for operating such a linear actuator is provided.

The linear actuator includes a solenoid pump (e.g., a dual-chamber solenoid pump). The linear actuator may include a hydraulic cylinder that is hydraulically connected to the solenoid pump. The hydraulic cylinder exhibits a hydraulic piston. The hydraulic piston is capable of being driven into and out of the hydraulic cylinder by the solenoid pump. The linear actuator may include a reservoir connected to the solenoid pump for the supply or removal of hydraulic oil.

According to one or more of the present embodiments, the solenoid pump in the linear actuator exhibits at least one pump coil, one multi-way valve, and at least one pump armature that may be moved by energizing the at least one pump coil. In the linear actuator, the solenoid pump includes a switching armature, by which the multi-way valve may be switched. According to one or more of the present embodiments, the switching armature in the solenoid pump of the linear actuator may be moved by energizing the at least one pump coil.

In the linear actuator, a bidirectional pump flow may be brought about by the multi-way valve. For this purpose, the multi-way valve may be fluidly connected to the inlet and the outlet of the solenoid pump. The linear actuator may include a suchlike multi-way valve for this purpose, which allows a bidirectional pump flow in the connection to the inlet and outlet of the solenoid pump. The hydraulic piston guided in the hydraulic cylinder may be guided bidirectionally by the bidirectional pump flow. The multi-way valve may be switched in order to change the direction of the pump flow. According to one or more of the present embodiments, the switching of the multi-way valve may be effected by energizing the at least one pump coil, which is to be energized in order to move the at least one pump armature. Previously disclosed linear actuators may include a pump and a multi-way valve separately. A dedicated drive is provided in each case for a pump and a multi-way valve. Consequently, an electrical control in each case and thus at least one pair of conductors are provided. One or more of the present embodiments integrate a solenoid pump and a multi-way valve advantageously in a single device. For example, a magnetic flow utilized according to one or more of the present embodiments is used both for operating the pump and, at the same time, for switching the multi-way valve. Consequently, this results in a particularly low electrical interconnection cost for the linear actuator. At the same time, a highly accurate adjustment path may be set with a linear actuator having a solenoid pump. The adjustment path is basically not restricted. Solenoid pumps also do not require a large installation space and are capable of being operated for long periods without wear and, for example, robustly in the face of adverse environmental conditions, such as contamination. Because of the extremely low interconnection cost, only a few electrical lines or conductors or conductor terminations are provided (e.g., in configurations having a multiplicity of linear actuators).

For example, only a single pair of electrical conductors or a single pair of conductor terminations is provided for the linear actuator of one or more of the present embodiments. As a result, the wiring cost is low and the reliability is high in the linear actuator.

In addition, the linear actuator of one or more of the present embodiments may use a dual solenoid pump in place of a simple solenoid pump. In the dual solenoid pump, the volumetric flow does not drop to zero for a prolonged period. Accordingly, pulsations in the volumetric flow and the pressure and associated disadvantages such as noise generation or increased wear as a result of induced vibrations may be avoided.

The solenoid pump (e.g., the dual solenoid pump) includes pot magnets. The pot magnets possess the advantage, when compared with otherwise frequently present yoke disks, that the fluid damping of yoke disks typically increases disproportionately shortly before impacting the yoke. Typical solenoid pumps use additional damping devices or incur special costs for the reduction of noise and vibration (see, for example, EP 1985857). A suchlike functional mechanism is already integrated advantageously in this further development, in which the solenoid pump or the dual solenoid pump includes pot magnets.

In the linear actuator of one or more of the present embodiments, the multi-way valve is a 4/2-way valve, or the multi-way valve exhibits a 4/2-way valve. In this way, the pump flow from the solenoid pump may be reversed particularly easily, in that the inlet and the outlet of the solenoid pump are connected to the switchable inlets and outlets of the 4/2-way valve.

Appropriately, in the solenoid pump of the linear actuator of one or more of the present embodiments, the multi-way valve may be switched by movement of the switching armature. The multi-way valve may be connected with movement to the switching armature for this purpose, so that a movement of the switching armature leads to a spatial displacement of the inlets and the outlets of the multi-way valve relative to the inlet and the outlet of the solenoid pump of the linear actuator. The multi-way valve may be switched particularly easily in this way.

In one embodiment, in the solenoid pump of the linear actuator, the pump armature is connected or is capable of being connected with a magnetic flow to a pump coil yoke. The switching armature is connected or is capable of being connected with a magnetic flow to the pump coil yoke. The connectability or the connection of the pump coil yoke with a magnetic flow to the pump armature and to the switching armature permits a movement of the switching armature to be achieved particularly easily by energizing the at least one pump coil.

In the solenoid pump of the linear actuator, at least two pump coils, each with a pump coil yoke, are present. The pump coil armature is capable of movement between the pump coil yokes or between at least two pump coil yokes. In one embodiment, in this case, a respective pump coil with a respective pump coil yoke belongs to a respective chamber of a solenoid pump that is configured as a dual-chamber solenoid pump.

In a further development of the linear actuator, there is present in the solenoid pump at least one flow-conducting device, by which the pump coil yokes are connected to one another in a flow-conducting manner. In another advantageous further development of the linear actuator, flow-conducting devices are embodied in one piece with the pump coil yokes in the solenoid pump, as previously described. This further development results from a particularly simple construction. In a further development of the linear actuator, the flow-conveying device or at least one of the pump coil yokes in the solenoid pump includes a permanent magnet, or a permanent magnet is arranged on the flow-conducting device or on at least one of the pump coil yokes. In this further development of the method, the permanent magnet may be used as a flow-generating element that attenuates or intensifies a magnetic flow that is generated with the at least one pump coil. In this way, in the linear actuator, a magnetic degree of freedom may be offered for the purpose of switching by the switching armature.

In a further development of the linear actuator, in the solenoid pump, the switching armature is capable of being defined by a magnetic flow that is generated by the permanent magnet, and, for example, is also conducted through the flow-conducting device. A further degree of freedom is accordingly also offered for the movement of the switching armature.

In the dual-chamber solenoid pump of the linear actuator, the at least one pump coil is electrically switched, and/or the at least one pump coil is arranged such that the magnetic flow generated thereby counteracts the magnetic flow that has been generated by the at least one permanent magnet, at least in a region of the flow-conducting means and/or at least one pump coil yoke. For example, the magnetic flow, which has been generated by the at least one permanent magnet, may be overcome. Accordingly, switching may be provided by the at least one pump coil.

The solenoid pump of the linear actuator may exhibit only a single pair of conductors or pair of conductor terminations, by which the solenoid pump is connected electrically. In this way, the electrical interconnection cost and/or the cost of activating the solenoid pump of the linear actuator, and thus the wiring cost of the linear actuator, is reduced significantly.

In this case, for example, the single pair of conductors or pair of conductor terminations is in electrical contact with the at least one or more pump coils.

In a further development, at least two pump coils that are configured in the form of pot magnets are present in the solenoid pump of the linear actuator. The pump armature and/or the switching armature may be movably guided transversely in relation to the pot bases of the pot magnet form. A simple and compact spatial construction may thus be achieved.

Diodes are present in the solenoid pump of the linear actuator. Positive signal portions of a signal that is present on the pair of conductors or the pair of conductor terminations may be transmitted to a first pump coil, and negative signal portions may be transmitted to a second pump coil by the diodes.

In the method for operating a linear actuator according to one or more of the present embodiments, the switching armature is set in a predetermined position in relation to the position of the multi-way valve by the energization of the at least one pump coil of the solenoid pump, and is moved, while maintaining the predetermined opposition, by energizing the at least one pump coil of the pump armature. In this way, the switching armature may be set, so that the multi-way valve is set appropriately for the operation of the pump. In this position, the pump armature is movable and the solenoid pump pumps in the intended unidirectional operation. In a further development of the method, the at least one pump coil is energized to a lesser degree for the movement of the pump armature than for the movement of the switching armature. The amplitude of the activation of the at least one pump coil may consequently be set depending on whether only the pump armature or also the switching armature is intended to be moved.

DETAILED DESCRIPTION

Figure 1:
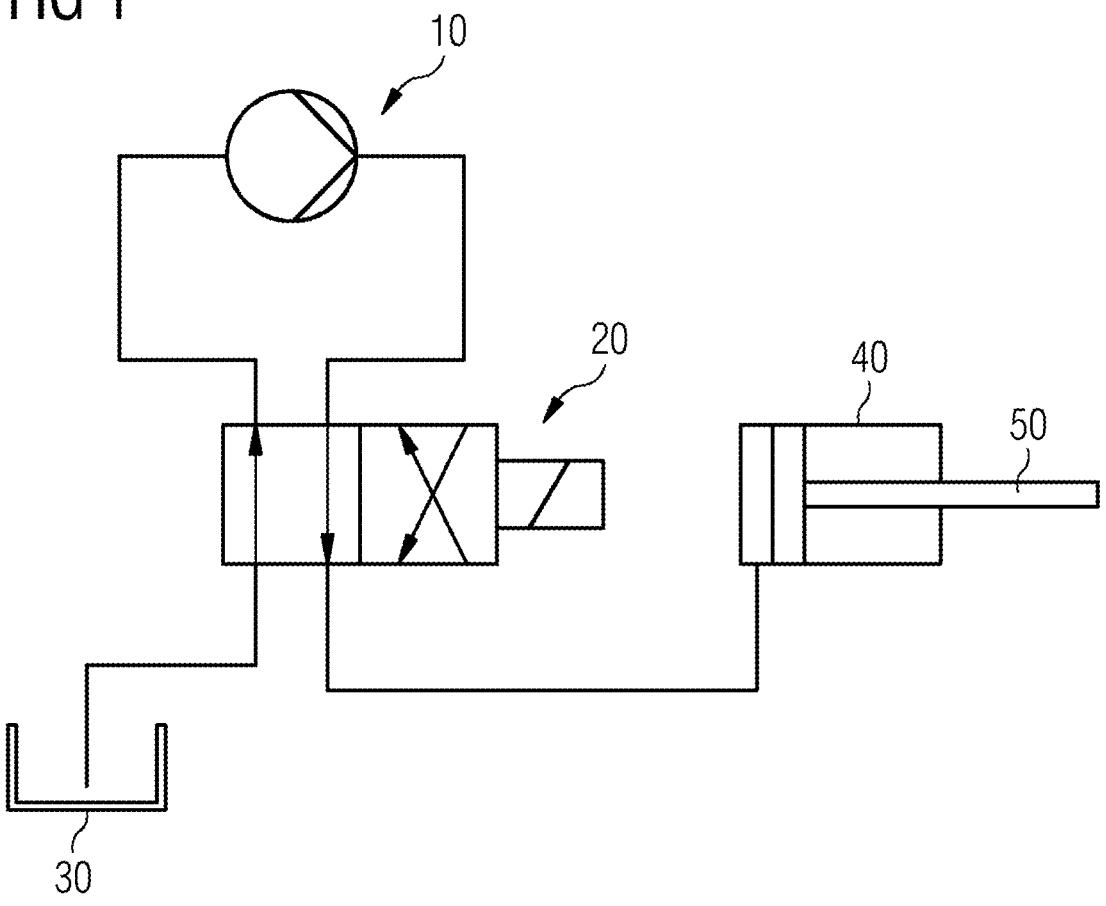
FIG. 1 depicts one embodiment of a linear actuator having a dual-chamber solenoid pump.

The linear actuator represented in FIG. 1 includes a dual-chamber solenoid pump 10 having a two-way valve 20, by which hydraulic fluid is pumped from a reservoir 30 into a working area of a hydraulic cylinder 40. A hydraulic piston 50 is movably guided in a linear fashion in the hydraulic cylinder 40. By setting the two-way valve 20 to the respective other switching position, the pump direction of the dual-chamber solenoid pump 10 may be reversed, so that hydraulic fluid is pumped back into the reservoir 30 from the working area of the hydraulic cylinder 40. The hydraulic piston 50 is moved forwards or backwards accordingly.

Figure 2B:
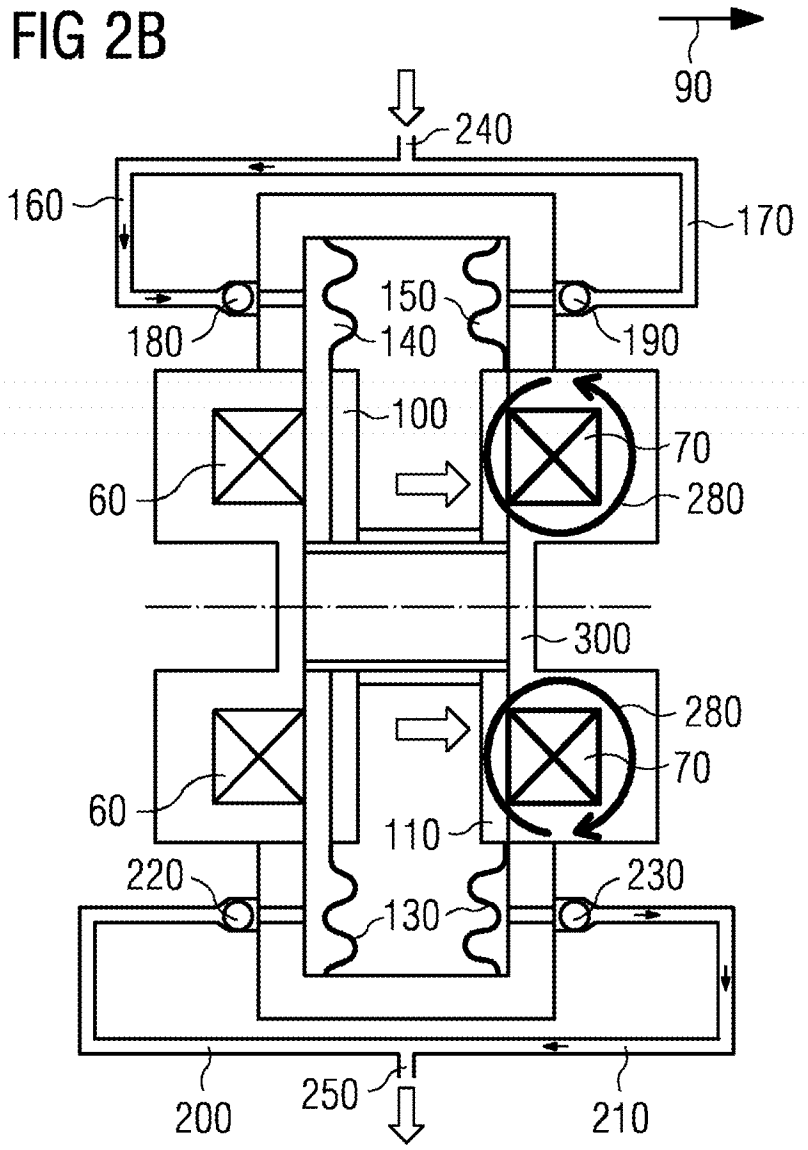
FIG. 2 depicts a longitudinal section of the dual-chamber solenoid pump of the linear actuator of FIG. 1 in a first switching position (A) and a second switching position (B)
Figure 2A:
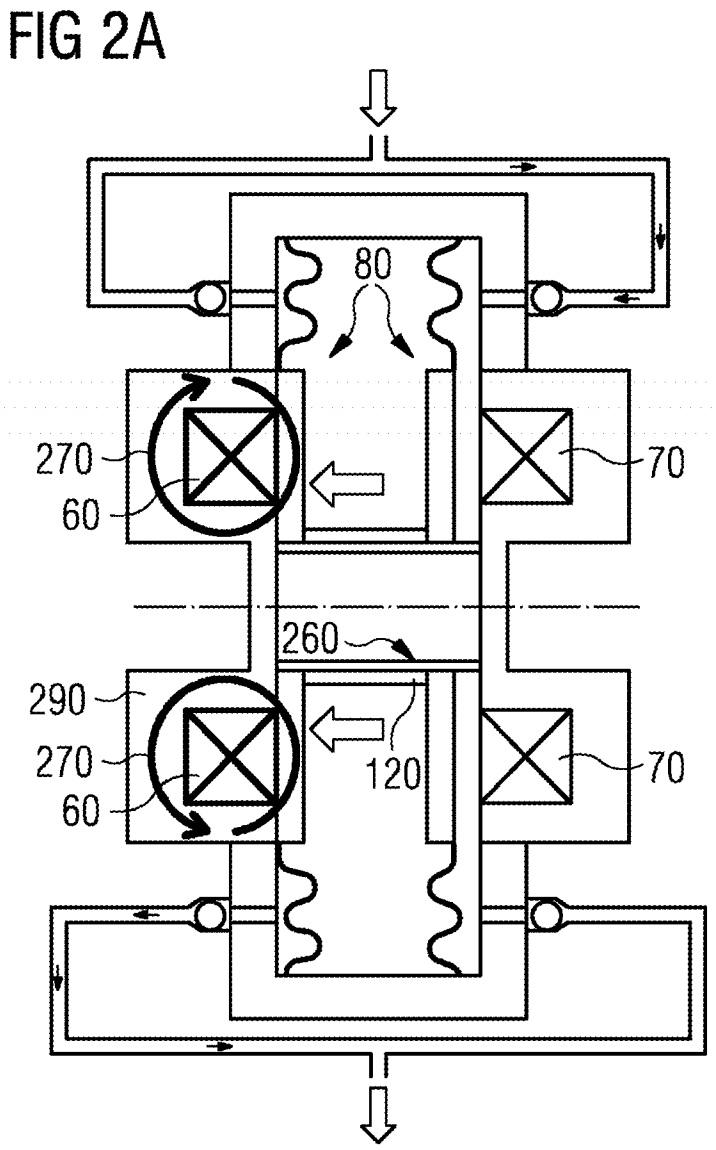

The construction of the dual-chamber solenoid pump 10 is depicted in more detail in FIGS. 2A and 2B. The dual-chamber solenoid pump 10 includes two pump coils 60 and 70. The two pump coils 60 and 70 are each configured in the form of a pot magnet. Present between the pump coils 60 and 70 is a magnetic pump armature 80. The magnetic pump armature 80 is guided in a direction 90 perpendicular to pot base planes of the two pump coils 60, 70. The pump armature 80 includes two soft-magnetic perforated disks 100, 110 that are connected to each other by a non-magnetic connecting pipe 120. The non-magnetic connecting pipe 120, with a longitudinal extent in the direction 90, extends perpendicularly to the pot base planes of the two pump coils 60, 70. The perforated disks 100, 110 are each suspended in a freely oscillating manner on diaphragms 130, which in each case delimits and seals hydraulic chambers 140, 150.

The hydraulic chambers 140 and 150 exhibit feed lines 160, 170 that discharge respectively into the hydraulic chambers 140, 150 to either side of the pump armature 80 via non-return valves 180, 190. In addition, the hydraulic chambers 140, 150 exhibit outlet pipes 200, 210 that lead away from the hydraulic chambers 140, 150 via non-return valves 220, 230. The supply pipes 160, 170 and the outlet pipes 200, 210 are brought together respectively on the input side and on the output side to form a common inlet 240 and a common outlet 250.

On the internal radius of the soft-magnetic perforated disks 100, 110 the hydraulic chambers 140, 150 are sealed by a non-magnetic pipe 260, on which the pump armature 80 slides back and forth.

Figure 3:
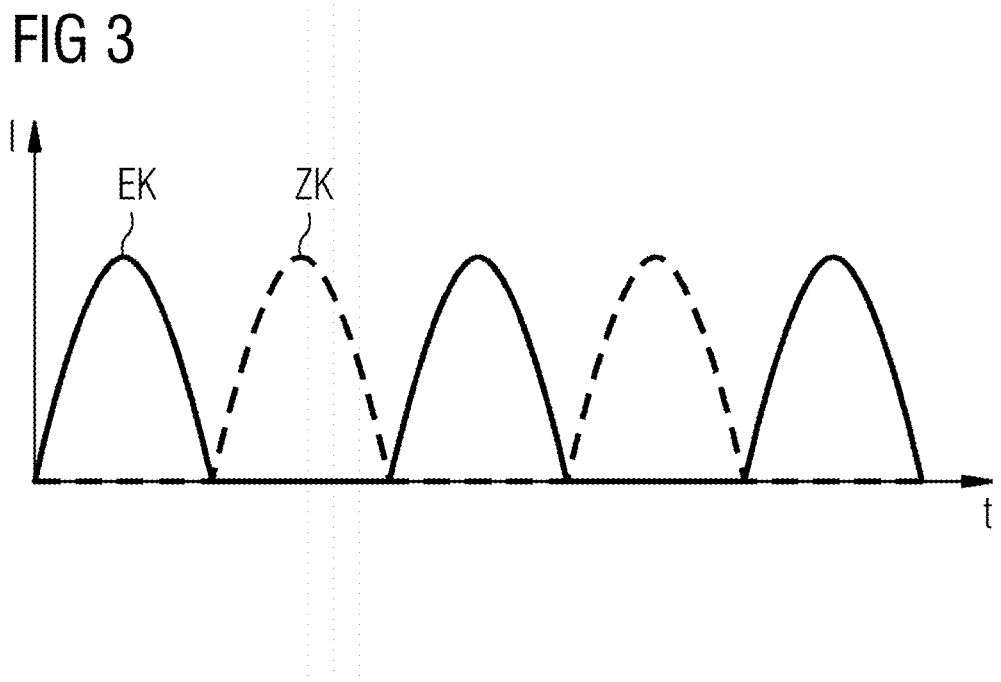
FIG. 3 depicts a diagrammatic representation of an exemplary activation of a first pump coil and a second pump coil.

The pump effect is achieved by the activation of the pump coil 60, 70 represented in FIG. 3 (e.g., the current strength I of the energization of the left-hand pump coil 60 (curve EK) or the right-hand pump coil 70 (curve ZK) is shown in each case as a function of the time t). Either the left-hand pump coil 60 or the right-hand pump coil 70 is energized alternately. The pump armature 80 is drawn alternately to the left or to the right as a consequence of the magnetic reluctance principle (e.g., the desire to close the magnetic flow circuit appropriately). The arrows 270, 280 illustrate the underlying magnetic flow through the pump coil yoke 290, 300 in each case enclosing a pump coil 60, 70 partially around a corresponding circumference. The pump coil yoke 290, 300 in each case respectively encloses the pump coils 60, 70 on respective sides facing away from the other pump coil 70, 60, in each case partially around the corresponding circumference. The hydraulic volume that is present between the pump coil 60, 70 and the pump armature 80 is reduced and increased alternately by the movement of the pump armature 80 to the left or to the right. This hydraulic volume is filled with hydraulic fluid (e.g., silicon oil or glycerin in the represented illustrative embodiment). The pulsating changes in pressure consequently result in a unidirectional flow of the hydraulic oil from the inlet 240 to the outlet 250.

In order to change the direction of the unidirectional flow, a two-way valve 20 in the form of a 4/2-way valve is provided, as illustrated in FIG. 1. The two-way valve 20 is moved by a switching armature 310 and is therefore switched. The switching armature 310 is integrated into the dual-chamber solenoid pump 10, as illustrated in FIG. 4.

A non-magnetic guide rod 320 is passed through the non-magnetic tube 260 at the center in the direction 90 perpendicularly to the pot base planes. This non-magnetic guide rod 320 is able to slide in the direction 90 perpendicularly to the pot base planes (e.g., horizontally in the representation according to FIG. 4). A switching armature 310 made of a soft-magnetic material is attached to the non-magnetic guide rod 320. In order to move the switching armature 310 in the horizontal direction (e.g., in the direction 90), the pump coil yoke 290 and the pump coil yoke 300 are connected via a flow-conducting device 330 radially remotely from the non-magnetic connecting pipe 120 in the horizontal direction 90. In the radial direction, the flow-conducting device 330 exhibits protrusions 340 that extend radially in the direction of the non-magnetic connecting pipe 120.

Figure 4B:
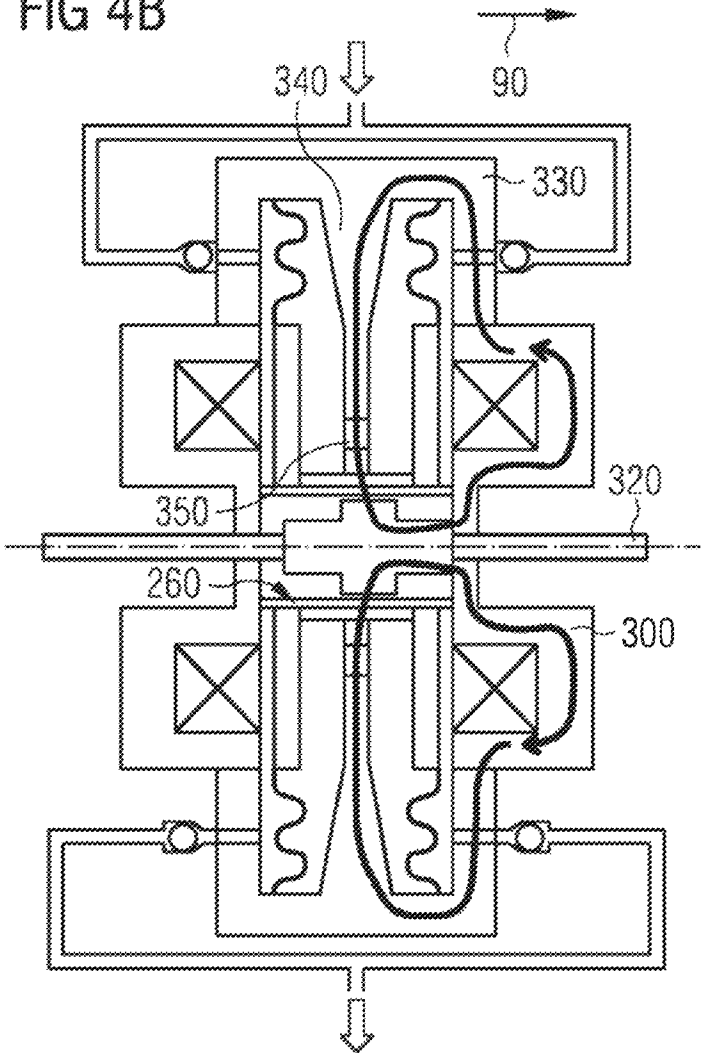
FIG. 4 depicts a longitudinal section of the dual-chamber solenoid pump according to FIG. 2 in two switching positions of a switching armature.
Figure 4A:
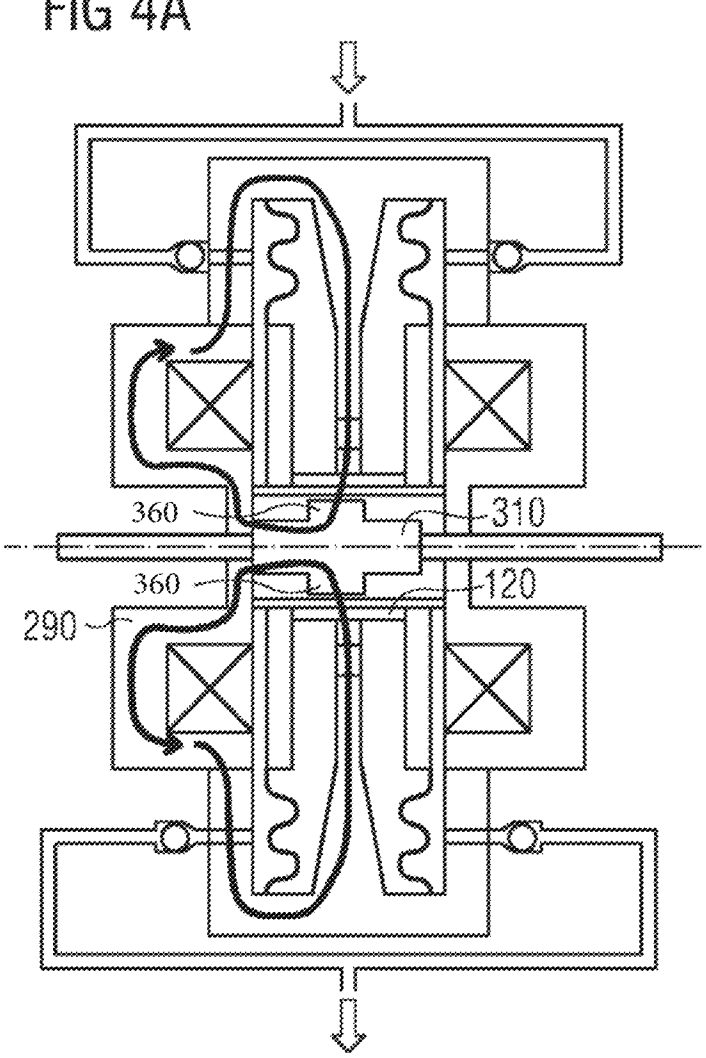

At an internally situated radial end, a radially extending bar magnet 350 is attached in each case to the protrusion 340. The switching armature 310 also exhibits corresponding protrusions 360 that extend along the switching armature 310 in the horizontal direction to such an extent that the protrusions 360 constantly overlap in the horizontal direction with the radially inward-facing protrusions 340 of the flow-conducting device 330, when the switching armature 310 makes contact with the left-hand pump coil yoke 290 or the right-hand pump coil yoke 300 (FIGS. 4A and 4B). If the switching armature 310 is present in the left-hand position, as depicted in FIG. 4A, the magnetic flow of the bar magnet 350 is conducted mainly over the air gap (e.g., minimal air gap) and through the left-hand pump coil yoke 290, because of the lower magnetic reluctance on this side. A holding force, which holds the switching armature 310 in this position, is produced there as a result. Analogously, according to FIG. 4B, the switching armature is held in the right-hand position (e.g., the switching armature 310 is held in a position in each case both in the left-hand position of the switching armature 310 and in the right-hand position of the switching armature 310).

Figure 6:
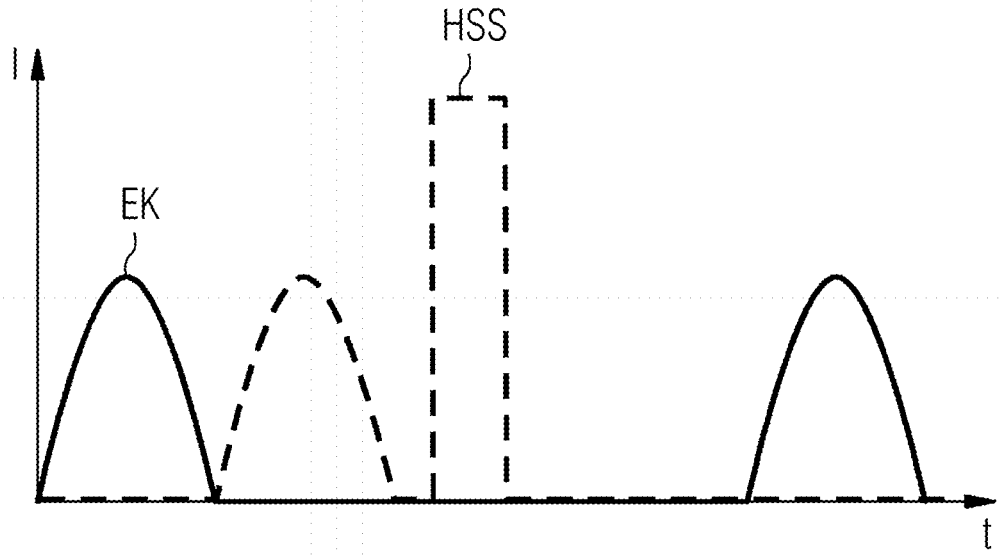
FIG. 6 depicts a diagrammatic representation of an exemplary energizing of the first pump coil and the second pump coil for the activation of the pump armature and of the switching armature.

In order to move the switching armature 310 from one position to the next position, a high current signal HSS is used for a short time, as depicted in FIG. 6. By way of example, the switching armature 310 is moved to the right by this short-time high current signal HSS. The right-hand pump coil 70 is subjected to a high current signal HSS for a short time. As a result of this current signal HSS, the temperature of the right-hand pump coil 70 increases for a short time (e.g., the pump coils 60, 70 in each case are not actually designed for currents at a high level such as that reached in the case of the current signal HSS). Alternatively, the pump coils 60, 70 may be configured for such high currents in further, not especially represented illustrative embodiments.

Before the normal pump sequence (see also FIG. 4) is resumed, the right-hand pump coil 70 is thus able to cool down during a short waiting period.

Figure 5:
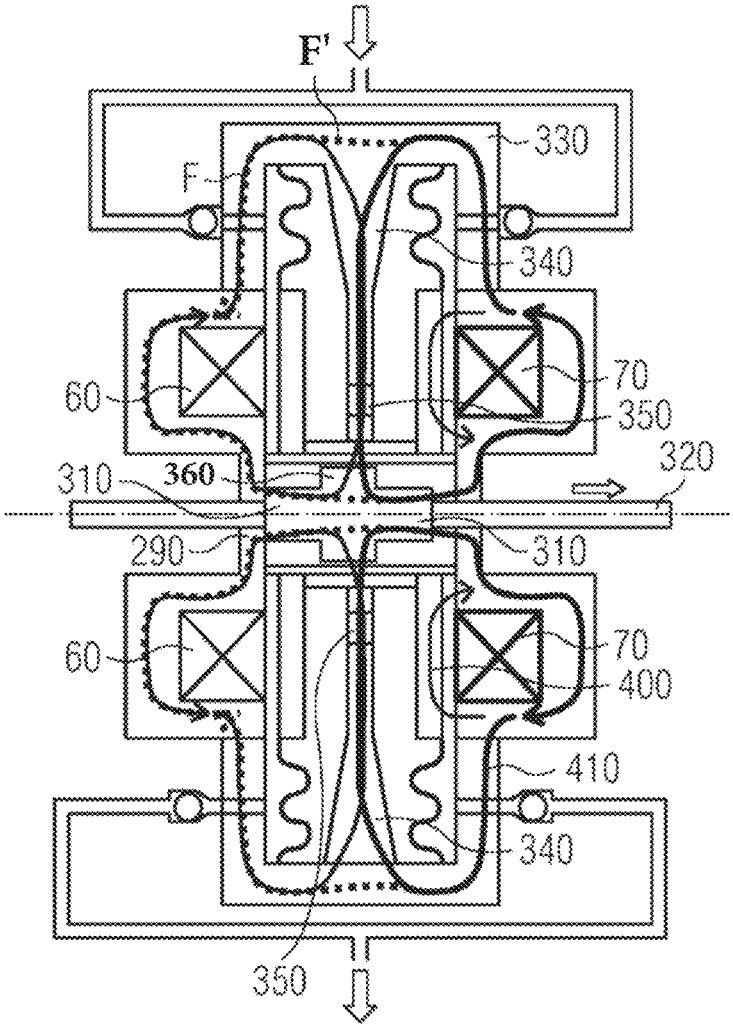
FIG. 5 depicts a longitudinal section of the switching principle of the switching armature in a schematic representation of the dual-chamber solenoid pump according to FIG. 2.

The magnetic behavior during the switching operation is depicted in FIG. 5. The presence of the high current actually causes the pump armature 80 to be drawn onto the side of the right-hand energized pump coil 70, as is also the case in the pump sequence. The energization of the pump coil 70 is nevertheless so high that the magnetic circuit through the right-hand pump coil yoke 300 and the pump armature 80 (e.g., thin arrows 400 enclosing the right-hand pump coil 70 around the circumference of the righthand pump coil 70) rapidly becomes supersaturated. The magnetic flow will thus also flow via the flow-conducting device 330 of the bistable actuator. The magnetic flow F' depicted with broken lines flows in the opposite direction to the flow of the bar magnet 350 on the holding side of the switching armature 310. By the appropriate choice of the current amplitude in conjunction with the energization of the pump coil 70, it is possible to provide that the flow of the pump coil 70 in the opposite direction is equally as high as the magnetic flow F of the bar magnet 350. As a result, the holding force of the switching armature 310 is effectively increased. A magnetic flow 410 (e.g., thick, drawn through), however, flows via the large air gap to the right of the switching armature 310. This flow produces an attracting force, which finally draws the switching armature 310 to the right. The current may then be switched off, and the switching armature 310 remains stable at that point as a result of the flow path depicted in FIG. 4B.

Figure 7:
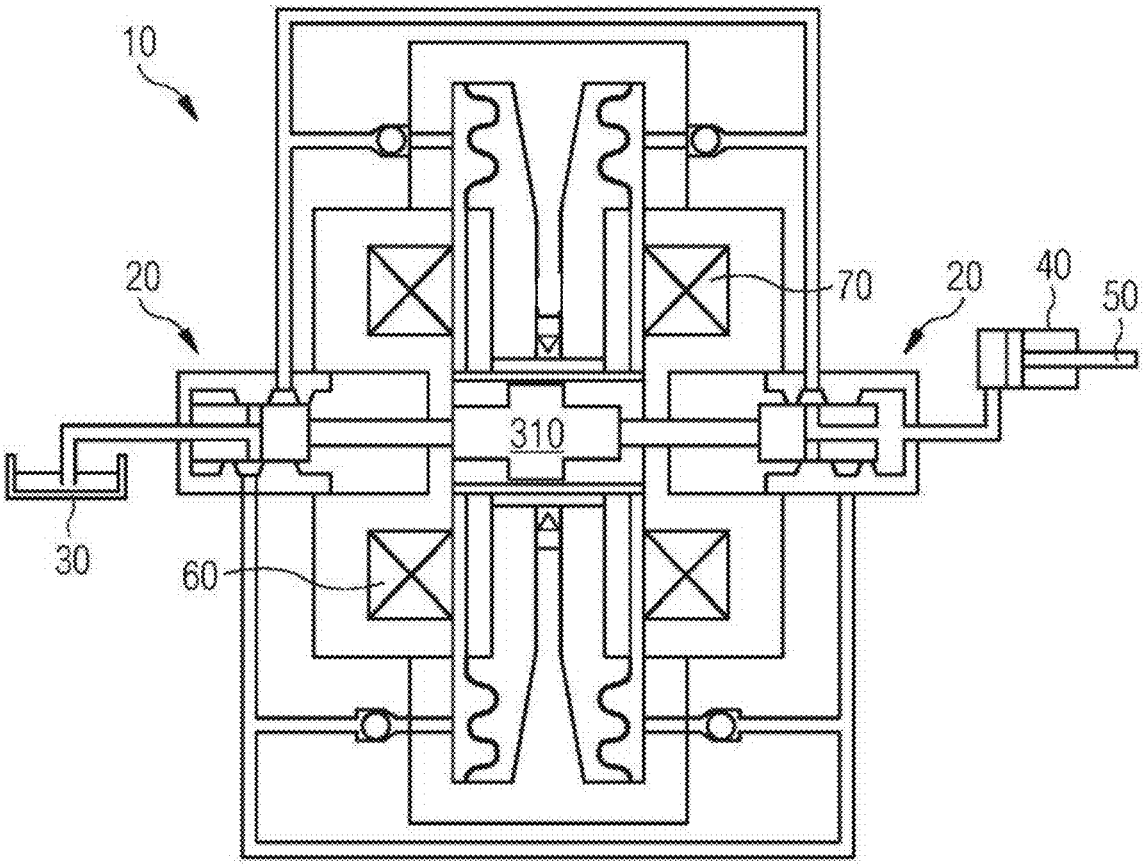
FIG. 7 depicts a longitudinal section of the linear actuator according to FIG. 1.
Figure 8:
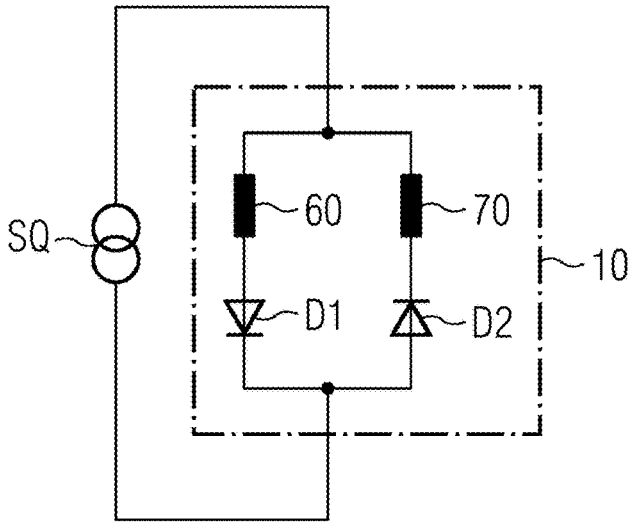
FIG. 8 depicts exemplary electrical circuitry of the linear actuator according to FIGS. 1 and 7.
Figure 9:
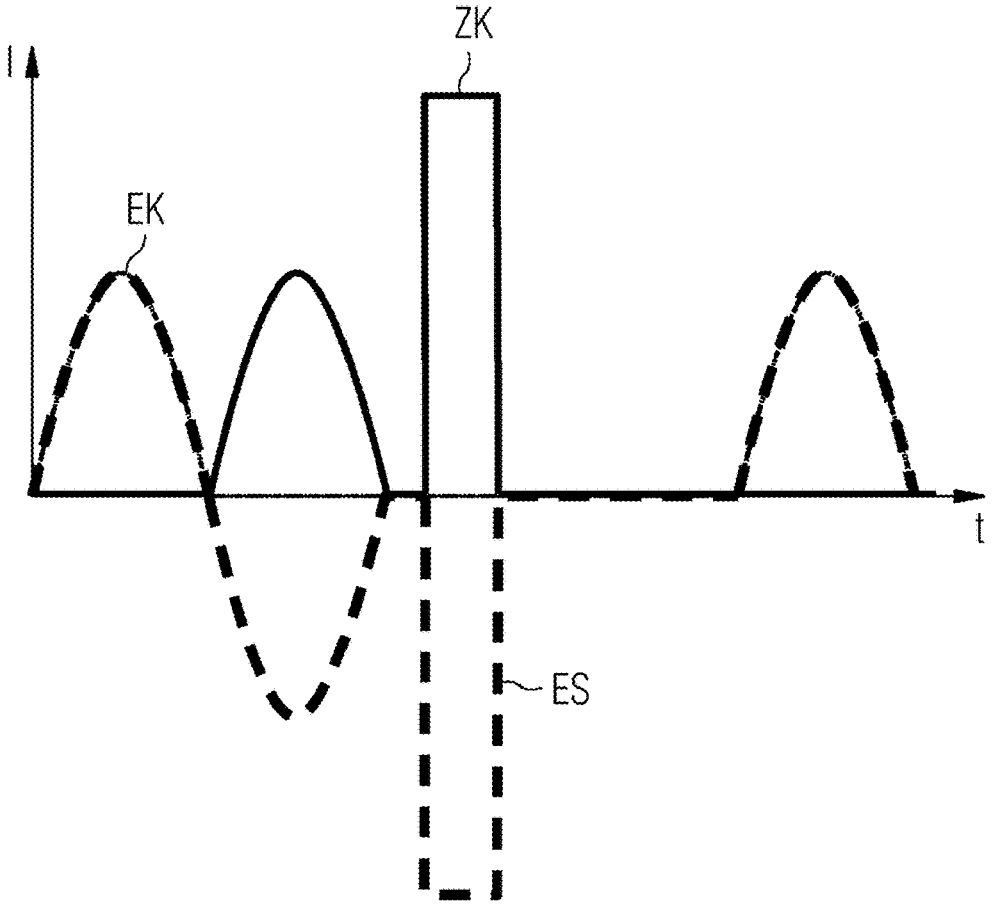
FIG. 9 depicts in a diagrammatic representation of an exemplary input signal for the activation of the linear actuator and exemplary coil signals according to the circuitry of the linear actuator according to FIG. 8.

A switching operation is thus initiated by a briefly excessive energization (e.g., by a short-time current signal HSS having an excessive amplitude). The actuator as a whole is finally interconnected according to the principle drawing in FIG. 1. Together with the envisaged two-way valve 20, this is represented schematically in FIG. 7, which corresponds to FIG. 1. The circuit depicted in FIG. 8 is used to transmit the current signals, which act upon two pump coils (e.g., pump coil 60 and pump coil 70), as depicted in FIG. 3 and FIG. 6, via a single pair of conductors. A signal source SQ supplies a single input signal ES with positive and negative signal components. The linear actuator includes two diodes D1, D2, by which the positive signal component EK is switched onto the pump coil 60, and the negative signal component ZK is switched onto the pump coil 70. This is depicted in FIG. 9 by way of example.

The two-part pump actuator 80, as represented in FIG. 2, includes two magnetic perforated disks 100, 110 and a non-magnetic connecting pipe 120. For reasons of stability, the connection of the two perforated disks 100, 110 may also be effected with further, stabilizing connecting parts 500 that are arranged additionally to the non-magnetic connecting pipe 120 as supporting cylindrical elements between the perforated disks 100, 110.

Figure 10A:
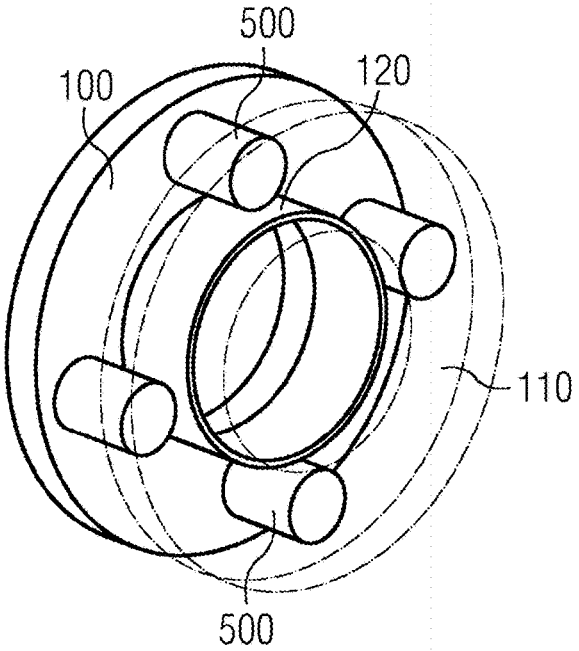
FIG. 10 depicts a perspective representation of the pump armature of the linear actuator according to FIG. 1 (A) and a diagrammatic representation of the pump armature according to FIG. 10 (A) in an arrangement together with a flow conducting device of the linear actuator of FIG. 1.
Figure 10B:
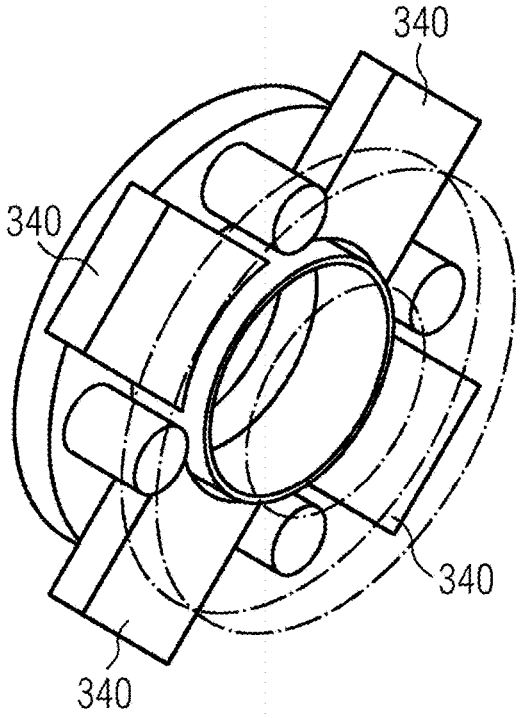

The protrusions 340 of the flow-conducting device 330 represented in FIG. 4 lie between the perforated disks 100, 110 and may not be of a rotationally symmetrical embodiment, as represented in FIG. 10 (B), but may protrude radially onto the non-magnetic connecting pipe 120 from four directions offset from one another at a right angle.

Figure 11:
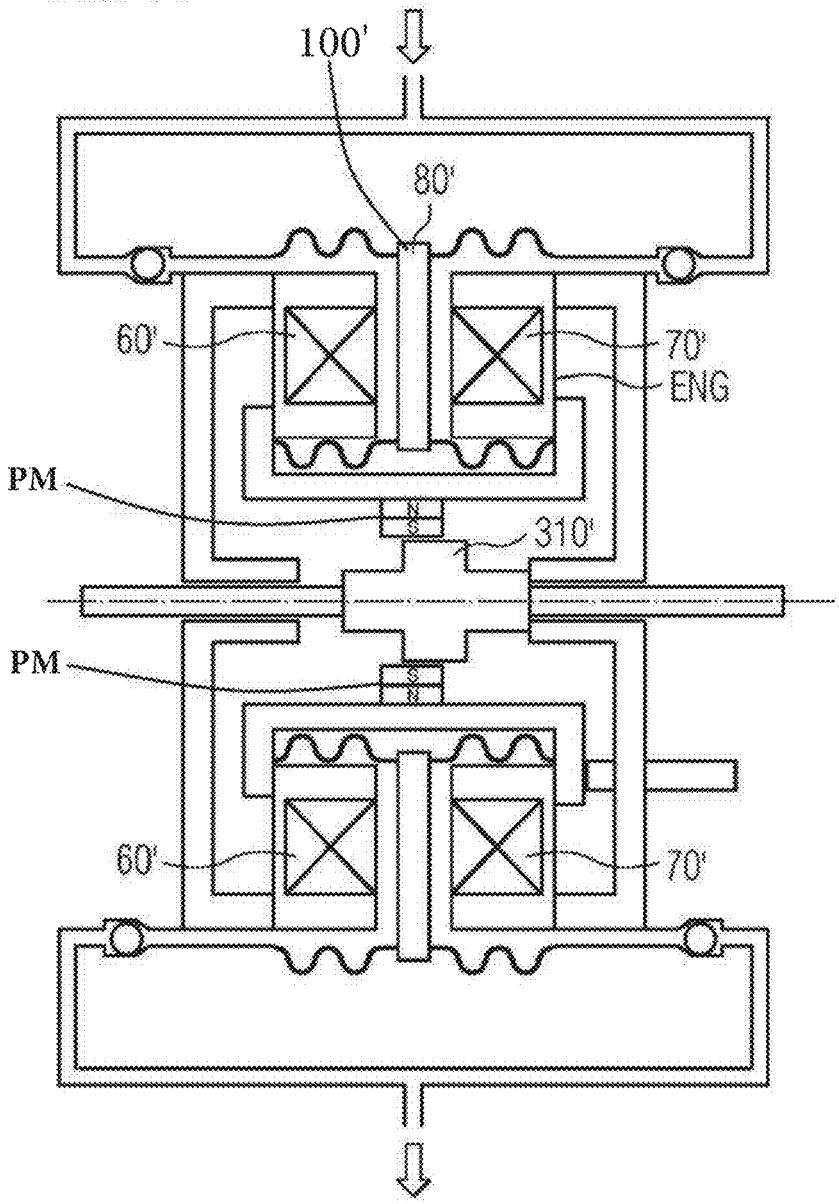
FIG. 11 depicts an alternative embodiment of a linear actuator having a single-piece pump armature.

As represented in FIG. 11, a two-part armature may be entirely avoided. For example, the pump armature 80' may be realized as a single perforated disk 100'. In this case, however, the pump armature 80' is to be guided on the internal radius (e.g., by a further bellows). Magnetic flow is generated by a permanent magnet PM. In this case, the magnetic flow may only be led out "to the rear" from the pump coils 60', 70' in the direction of the bistable switching armature 310'. A magnetic constriction ENG is thus incorporated here.

Figure 12:
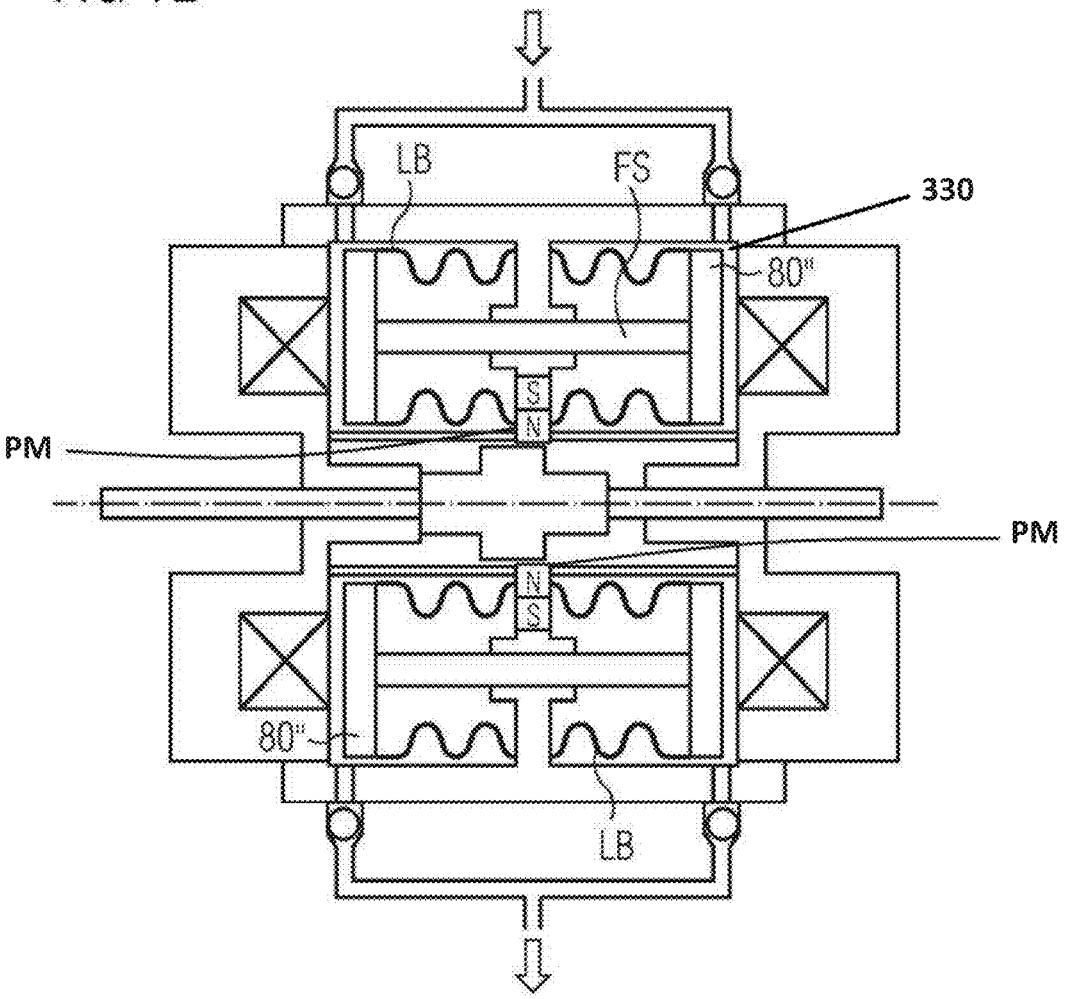
FIG. 12 depicts a further alternative embodiment of a linear actuator.

The linear actuator of one or more of the present embodiments is of thin and elongated configuration in a further embodiment (e.g., "pencil-like"). Longitudinal bellows LB are used in place of diaphragm bellows, as depicted in FIG. 12, and the two-part pump armature 80" is provided with longitudinal bellows LB both on the internal radius and on the external radius. The guiding is realized by a number of non-magnetic guide rods FS. In other respects, the design (e.g., the magnetic design) is completely identical with FIG. 4.

The elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent. Such new combinations are to be understood as forming a part of the present specification.

While the present invention has been described above by reference to various embodiments, it should be understood that many changes and modifications can be made to the described embodiments. It is therefore intended that the foregoing description be regarded as illustrative rather than limiting, and that it be understood that all equivalents and/or combinations of embodiments are intended to be included in this description.

The invention claimed is:

1. A linear actuator comprising:

a solenoid pump having:

a housing;

at least two pump coils, each pump coil having a pump coil yoke;

a multi-way valve;

at least one pump armature positioned within the housing of the solenoid pump, wherein the at least one pump armature is movable by energizing one pump coil of the at least two pump coils;

at least one flow-conducting device by which the pump coil yokes of the at least two pump coils are connected to one another in a flow-conducting manner; and a switching armature positioned within the housing of the solenoid pump between the at least two pump coils, wherein the switching armature is movable by energizing one pump coil of the at least two pump coils, wherein the multi-way valve is switchable by movement of the switching armature.

2. The linear actuator of claim 1, wherein the multi-way valve is or exhibits a 4/2-way valve.

3. The linear actuator of claim 1, wherein in the solenoid pump, the at least one pump armature is connected with a magnetic flow to a pump coil yoke, wherein the switching armature is connected with the magnetic flow to the pump coil yoke, and wherein the magnetic flow is configured to operate the solenoid pump and, at a same time, switch the multi-way valve.

4. The linear actuator of claim 1, wherein the at least one pump armature is movable between the pump coil yokes.

5. The linear actuator of claim 1, wherein the at least one flow-conducting device and the pump coil yokes are configured in one piece with one another.

6. The linear actuator of claim 1, wherein the at least one flow-conducting device or at least one pump coil yoke of the pump coil yokes comprises a permanent magnet, or wherein the permanent magnet is arranged on the at least one flow-conducting device or the at least one pump coil yoke.

7. The linear actuator of claim 6, wherein the permanent magnet is configured to generate a magnetic flow for the switching armature.

8. The linear actuator of claim 7, wherein the at least two pump coils are electrically switched, or wherein the at least two pump coils are arranged such that a magnetic flow generated by the at least two pump coils counteracts the magnetic flow generated by the permanent magnet at least in a region of the flow-conducting device, at least one pump coil yoke of the pump coil yokes, or both the flow-conducting device and the at least one pump coil yoke of the pump coil yokes.

9. The linear actuator of claim 1, wherein the solenoid pump exhibits only a single pair of conductors, by which the solenoid pump is connected electrically.

10. The linear actuator of claim 9, wherein the single pair of conductors is in electrical contact with the at least two pump coils.

11. The linear actuator of claim 9, wherein the solenoid pump comprises diodes, by which positive signal portions of a signal that is present on the single pair of conductors or a pair of conductor terminations is transmittable to a first pump coil of the at least two pump coils, and negative signal portions are transmittable to a second pump coil of the at least two pump coils.

12. A method for operating a linear actuator, the method comprising:

providing the linear actuator comprising a solenoid pump, the solenoid pump having: a housing; at least two pump coils, each pump coil having a pump coil yoke; a multi-way valve; at least one pump armature positioned within the housing of the solenoid pump, wherein the at least one pump armature is movable by energizing one pump coil of the at least two pump coils; at least one flow-conducting device by which the pump coil yokes of the at least two pump coils are connected to one another in a flow-conducting manner; and a switching armature positioned within the housing of the solenoid pump between the at least two pump coils; wherein the switching armature is movable by energizing one pump coil of the at least two pump coils, and wherein the multi-way valve is switchable by movement of the switching armature;

setting the switching armature in a predetermined position in relation to a position of the multi-way valve, the setting comprising the energization of the at least two pump coils; and moving the pump armature while maintaining the predetermined position, the moving of the pump armature while maintaining the predetermined position comprising energizing the at least two pump coils.

13. The method of claim 12, wherein the at least two pump coils are energized to a lesser degree for the movement of the pump armature than for the movement of the switching armature.

14. The linear actuator of claim 1, wherein the solenoid pump is a dual-chamber solenoid pump.

15. The linear actuator of claim 7, wherein the magnetic flow is configured to be conducted through the flow-conducting device.

16. A linear actuator comprising:

a solenoid pump having:

at least two pump coils;

a multi-way valve;

at least one pump armature integrated within the solenoid pump, wherein the at least one pump armature is movable by energizing one pump coil of the at least two pump coils;

a switching armature integrated within the solenoid pump, by which the multi-way valve is switchable, wherein the switching armature is movable by energizing one pump coil of the at least two pump coils; and at least one flow-conducting device, wherein a magnetic flow is configured to be conducted through the at least one flow-conducting device, and wherein the magnetic flow is configured to operate the solenoid pump and, at a same time, switch the multi-way valve.

* * * * *